US009635940B2

(12) United States Patent
Letham

(10) Patent No.: US 9,635,940 B2
(45) Date of Patent: May 2, 2017

(54) EXPANDABLE WALL STORAGE SYSTEM

(71) Applicant: Solutions Murales Proslat Inc., Châteauguay (CA)

(72) Inventor: Éric Letham, Léry (CA)

(73) Assignee: SOLUTIONS MURALES PROSLAT INC., Chateauguay, Quebec (CA)

( * ) Notice: Subject to any disclaimer, the term of this patent is extended or adjusted under 35 U.S.C. 154(b) by 0 days.

(21) Appl. No.: 14/811,603

(22) Filed: Jul. 28, 2015

(65) Prior Publication Data

US 2017/0027320 A1 Feb. 2, 2017

(51) Int. Cl.

| | |
|---|---|
| ***A47B 95/00*** | (2006.01) |
| ***A47B 45/00*** | (2006.01) |
| ***A47B 55/02*** | (2006.01) |
| ***A47B 81/00*** | (2006.01) |

(52) U.S. Cl.

CPC ..... *A47B 95/008* (2013.01); *A47B 45/00* (2013.01); *A47B 55/02* (2013.01); *A47B 81/00* (2013.01)

(58) Field of Classification Search

CPC ..... A47B 95/008; A47B 45/00; A47B 55/02; A47B 81/00; A47B 47/00; A47B 47/0025; A47B 47/021; A47B 47/022

USPC ..... 211/90.01, 90.02, 90.03, 90.04

See application file for complete search history.

(56) References Cited

U.S. PATENT DOCUMENTS

| | | | | | |
|---|---|---|---|---|---|
| 1,599,653 | A * | 9/1926 | Cranston | A47B 96/028 | 108/185 |
| 4,360,181 | A * | 11/1982 | Burkholder | A47B 96/061 | 108/108 |
| 4,603,781 | A * | 8/1986 | Ryan, Jr. | A47F 5/01 | 211/153 |
| 5,257,766 | A * | 11/1993 | Riblet | B21D 53/74 | 108/108 |
| 6,089,383 | A * | 7/2000 | Heneveld | A47B 81/00 | 182/129 |
| 6,164,465 | A * | 12/2000 | Schroeder | A47B 43/00 | 211/149 |
| 8,333,158 | B2 * | 12/2012 | Wise | A47B 46/005 | 108/108 |
| 2005/0150850 | A1 * | 7/2005 | Stitchick | A47B 47/022 | 211/90.03 |
| 2005/0230577 | A1 * | 10/2005 | Chen | A47B 55/02 | 248/215 |
| 2006/0027516 | A1 * | 2/2006 | Chen | A47B 96/027 | 211/183 |
| 2011/0266237 | A1 * | 11/2011 | Artigues | A47B 61/003 | 211/90.02 |

(Continued)

*Primary Examiner* — Daniel Rohrhoff
(74) *Attorney, Agent, or Firm* — Eversheds Sutherland (US) LLP

(57) ABSTRACT

An expandable wall storage system designed to provide maximum storage without loss of floor space. The system provides functional storage for bulky items on top, the flexibility to hang items below and the ability to see what is on the shelf through a gridded shelf. The system includes an interface defined by side portions and at least two support brackets of the storage system for engaging an adjacent expandable wall storage system when aligned in a side-by-side relationship. The system allows easy installation and avoids struggles with overhead mounting. The system can be provided in multiple length configurations and further extensions can also be provided.

12 Claims, 16 Drawing Sheets

(56) References Cited

U.S. PATENT DOCUMENTS

2012/0000867 A1* 1/2012 Saving ..... A47B 45/00
211/59.2

* cited by examiner

EXPANDABLE WALL STORAGE SYSTEM

FIELD OF THE INVENTION

The present invention generally relates to wall storage systems. More particularly, the present invention relates to an expandable wall storage system.

BACKGROUND OF THE INVENTION

Several storage systems have been developed to store and organize tools and other items in a storage area.

For example, U.S. Pat. No. 7,497,343 describes a storage system capable of a variety of configurations and adaptations. The basic units of the device include at least two generally triangular shaped braces, a plurality of square shaped tubular rails, and a variety of attachment devices that allow for a variously adjustable tiered storage system with slidable suspension hooks that allow the device to be variously configured and modified without the use of tools.

However, lateral expansion on either side of such a system as described above requires a purchase and installation of complete multiple copies of these storage systems. Such storages systems are not optimally designed for placement of one system beside another. Moreover, installation of an adjacent storage system can be rendered challenging by the mere presence of an initial storage system already installed on the wall which can hinder access to the wall for fastening of the adjacent system.

Hence, in light of the aforementioned, there is a need for a wall storage system which, by virtue of its design and components, addresses at least one of the above-mentioned needs.

SUMMARY OF THE INVENTION

One object of the present invention is to provide a wall storage system which addresses at least one of the above-mentioned needs.

In accordance with an aspect of the present invention, there is provided an expandable wall storage system mountable to a structural wall, the expandable wall storage system comprising:

a shelf support structure comprising a back portion, a front portion and side portions;

at least two support brackets for supporting said shelf support structure in a generally horizontally disposed position, each of said at least two support brackets comprising:

- a wall engaging portion configured to connect with a portion of the structural wall and said back portion; and
- a bracing portion extending upward from said wall engaging portion to said shelf support structure;

an interface defined by said side portions and said at least two support brackets for engaging an adjacent expandable wall storage system when aligned in a side-by-side relationship; and an attachment assembly provided on a portion of said interface for attaching the expandable wall storage system to an adjacent expandable wall storage system when aligned in a side-by-side relationship.

In some implementations, the attachment assembly is provided along said side portions.

In some implementations, the attachment assembly is provided along said at least two support brackets.

In some implementations, the attachment assembly comprises an expansion joint integrated within said interface for engaging an adjacent expandable wall storage system.

In some implementations, the expansion joint is a U-shaped interlocking structure shaped for receiving front and back portions of two adjacent expandable wall storage systems.

In some implementations, the attachment assembly further comprises one or more holes for receiving a fastener for attaching two adjacent expandable wall storage systems.

In some implementations, the system further comprises a shelf supported by said shelf support structure.

In some implementations, the shelf is a spaced wire shelf.

In some implementations, the system further comprises one or more hooks hanging from said spaced wire shelf.

The components, advantages and other features of the invention will become more apparent upon reading of the following non-restrictive description of some optional configurations, given for the purpose of exemplification only, with reference to the accompanying drawings.

DETAILED DESCRIPTION OF PREFERRED EMBODIMENTS OF THE INVENTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present invention illustrated in other figures can be easily inferred therefrom. The embodiments, geometrical configurations, materials mentioned and/or dimensions shown in the figures are optional, and are given for exemplification purposes only.

Furthermore, although the present invention may be used for storage purposes, for example, it is understood that it may be used for other purposes, such as displays. For this reason, expressions such as "wall storage system", etc. as used herein should not be taken as to limit the scope of the present invention to these applications in particular. These expressions encompass all other kinds of materials, objects and/or purposes with which the present invention could be used and may be useful, as can be easily understood.

Figure 1:
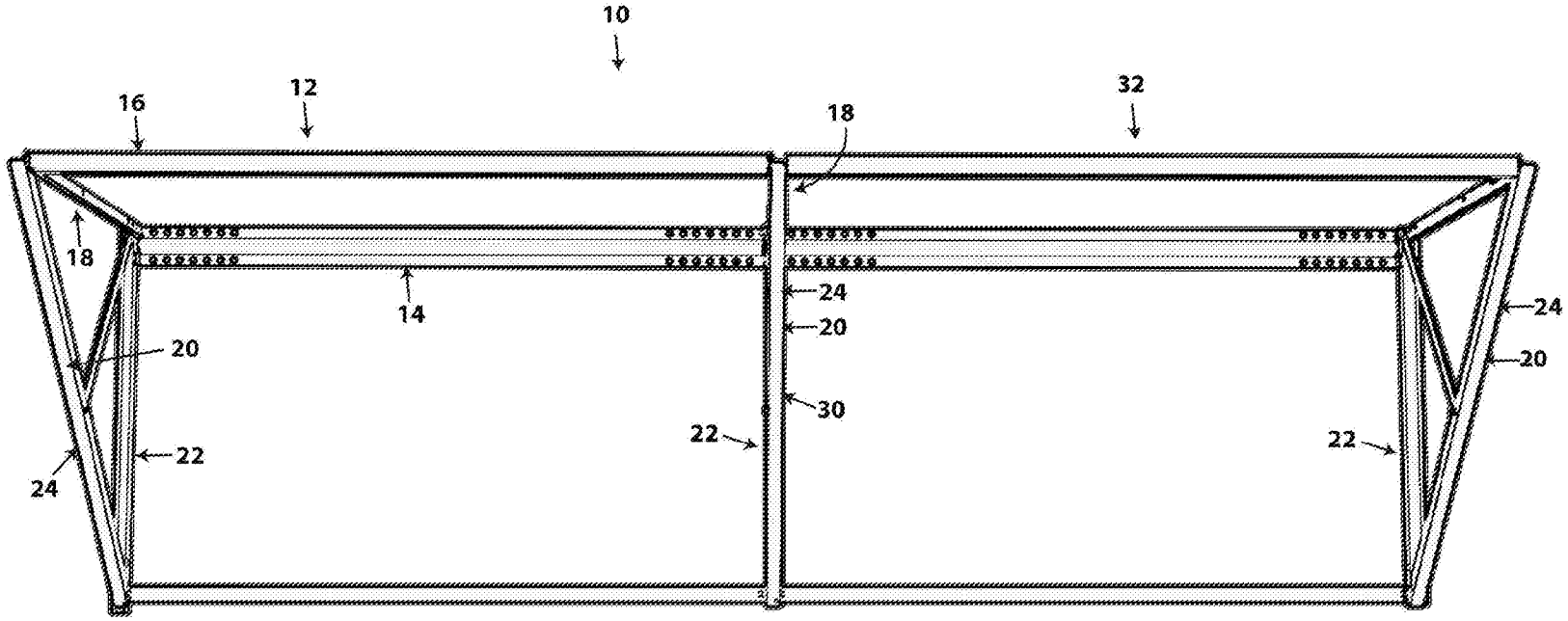
FIG. 1 is a perspective front view of a storage system according to a preferred embodiment of the present invention.

As shown in FIG. 1, there is provided an expandable wall storage system 10 mountable to a structural wall. The expandable wall storage system 10 includes a shelf support structure 12 comprising a back portion 14, a front portion 16 and side portions 18. Also provided are at least two support brackets 20 for supporting the primary shelf support structure 12 in a generally horizontally disposed position. Each of the at least two support brackets includes a wall engaging portion 22 configured to connect with a portion of the structural wall and the back portion 14 and a bracing portion 24 extending from the wall engaging portion 22 to the shelf support structure 12. An interface 30 is defined by the side portions 18 and the at least two support brackets 20 for engaging an adjacent expandable wall storage system 32 when aligned in a side-by-side relationship. An attachment assembly 34 (better shown in FIGS. 6 and 7) is provided on a portion of the interface 30 for attaching the expandable wall storage system 10 to an adjacent expandable wall storage system 32 when aligned in the side-by-side relationship.

Figure 6:
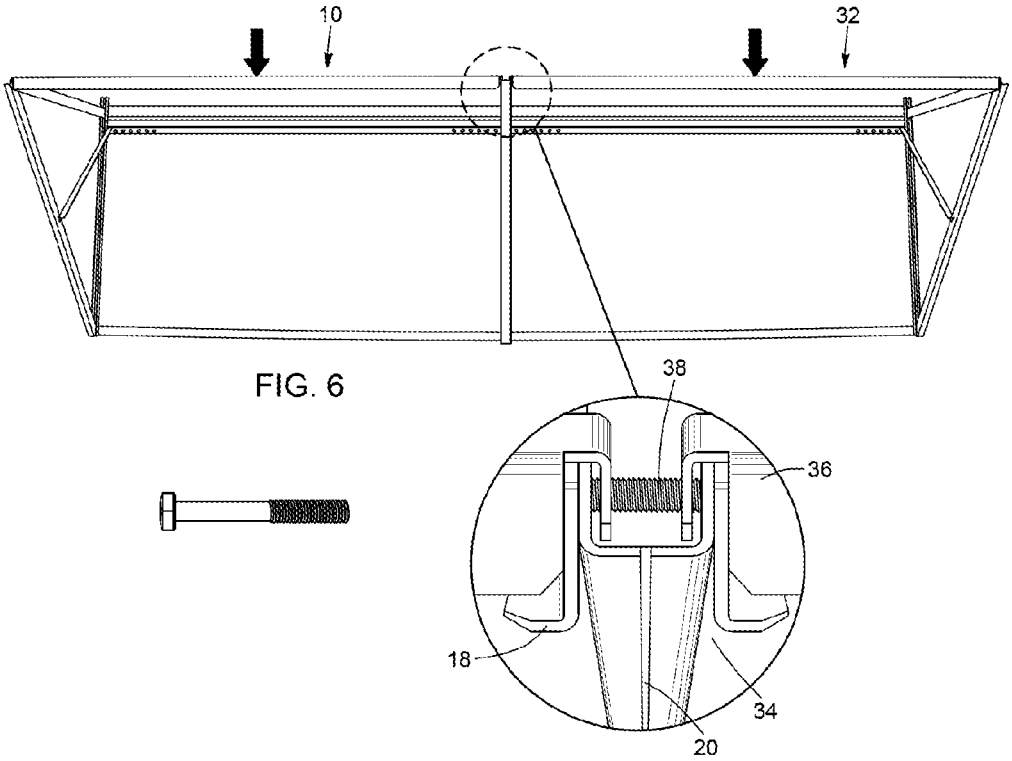
FIG. 6 is a perspective view illustrating an installation step of the storage system shown in FIG. 1.

In some implementations, as better shown in FIG. 6, the attachment assembly 34 is provided along the side portions 18.

In some implementations, the attachment assembly 34 is provided along the at least two support brackets 20.

In some implementations, the attachment assembly 34 comprises an expansion joint 36 integrated within the interface for engaging an adjacent expandable wall storage system.

In some implementations, the expansion joint 36 is a U-shaped interlocking structure shaped for receiving front and back portions of two adjacent expandable wall storage systems.

In some implementations, the attachment assembly 34 further comprises one or more holes for receiving a fastener 38 for attaching two adjacent expandable wall storage systems.

Figure 7:
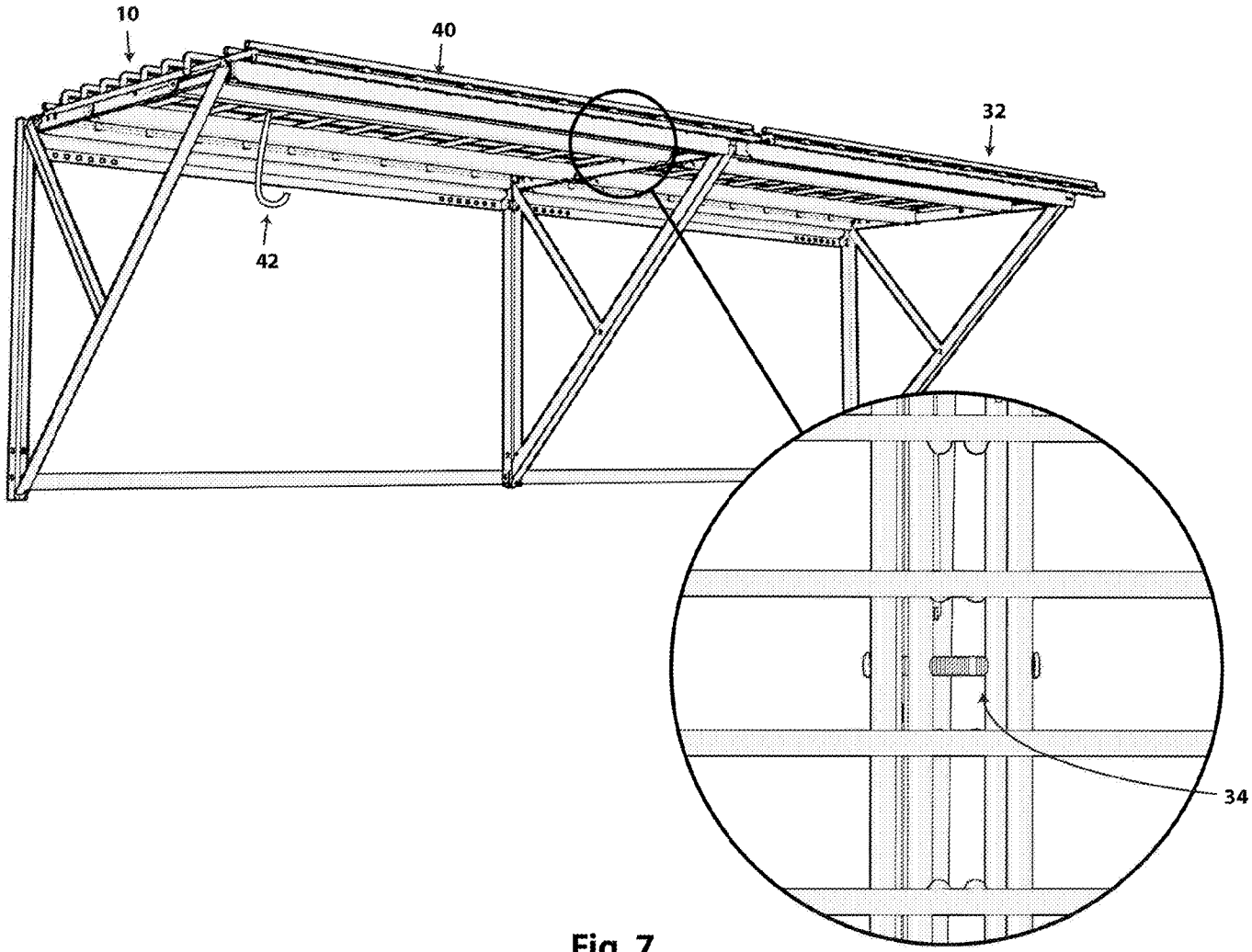
FIG. 7 is a perspective view of the storage system of FIG. 1 with a grid shelf installed.

In some implementations, as better shown in FIG. 7, the system further comprises a shelf 40 supported by the shelf support structure.

In some implementations, the shelf 40 is a spaced wire shelf.

Figure 8:
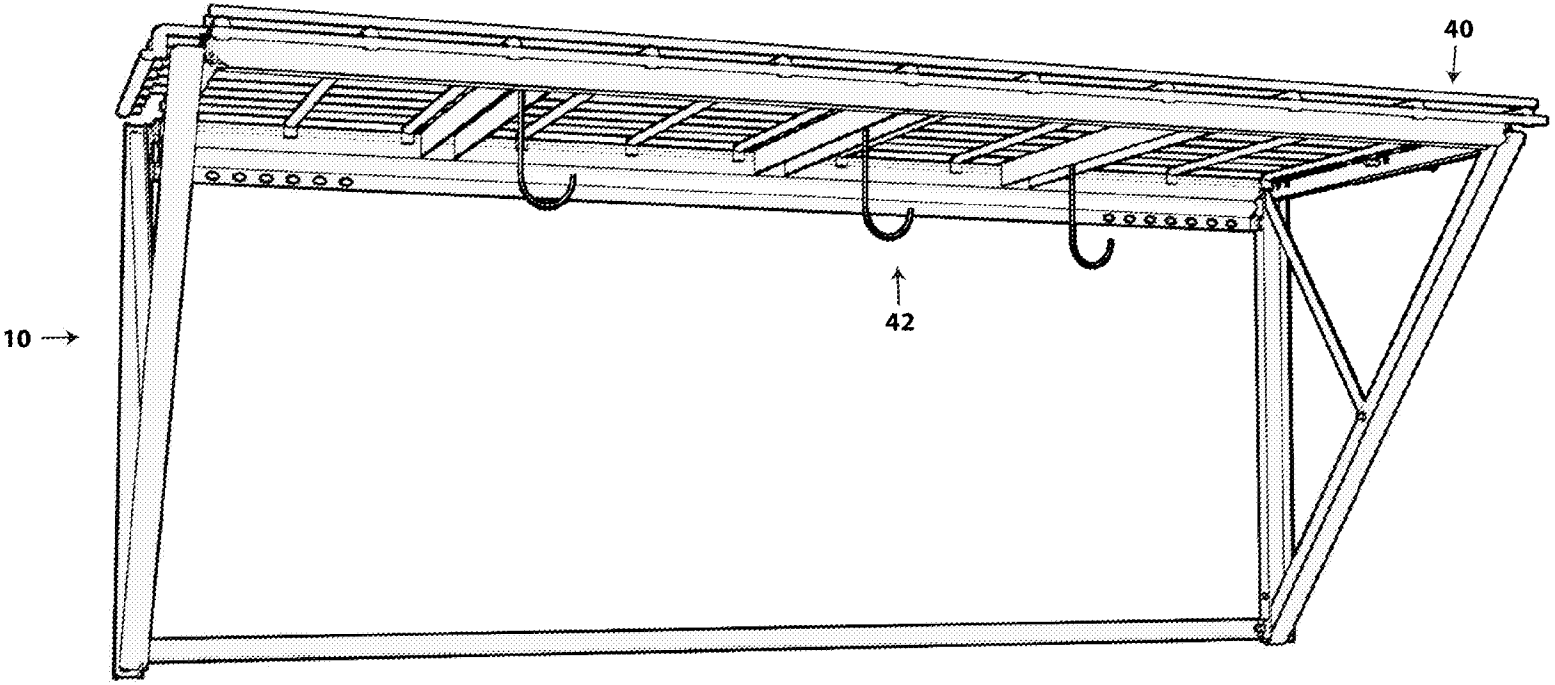
FIG. 8 is a front perspective view of a single unit of the storage system shown in FIG. 1 with items installed thereon.
Figure 9:
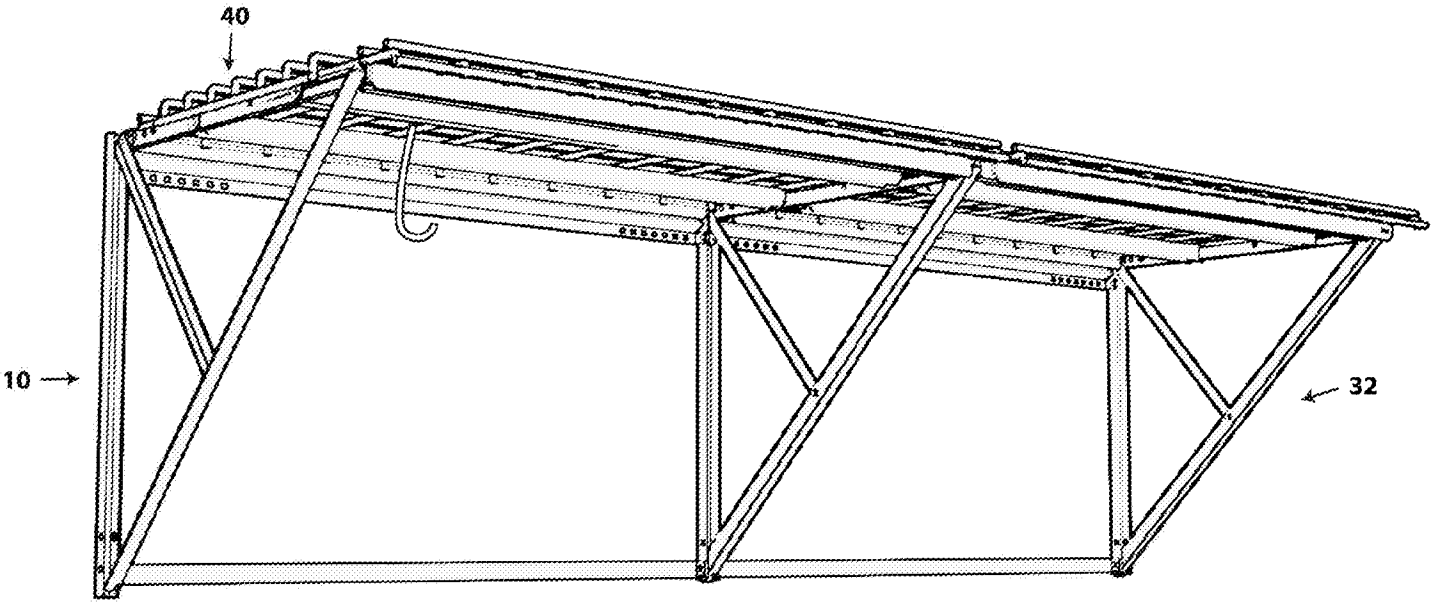
FIG. 9 is a front perspective view of the storage system shown in FIG. 1 with items installed thereon.

In some implementations, the system further comprises one or more hooks 42 hanging from the spaced wire shelf to support various objects as shown in FIGS. 8 and 9.

Preferably, the system can be used to form heavy duty wall racks that are built to last.

The system, in a preferred embodiment thereof, offers the following features:

Heavy duty reinforced steel grid shelf
Modular & expandable system
Supports up to 800 lbs
Powder coated baked paint
Assembled dimensions: 48" W×28"D×28"H per system
Easy to install and maintain
Made of high-load bearing steel for years of durability
Includes mounting hardware Preferably, the system can include 4 coated S-hooks that can each support up to at least 50 lbs.

Assembly Instructions

Figure 10:
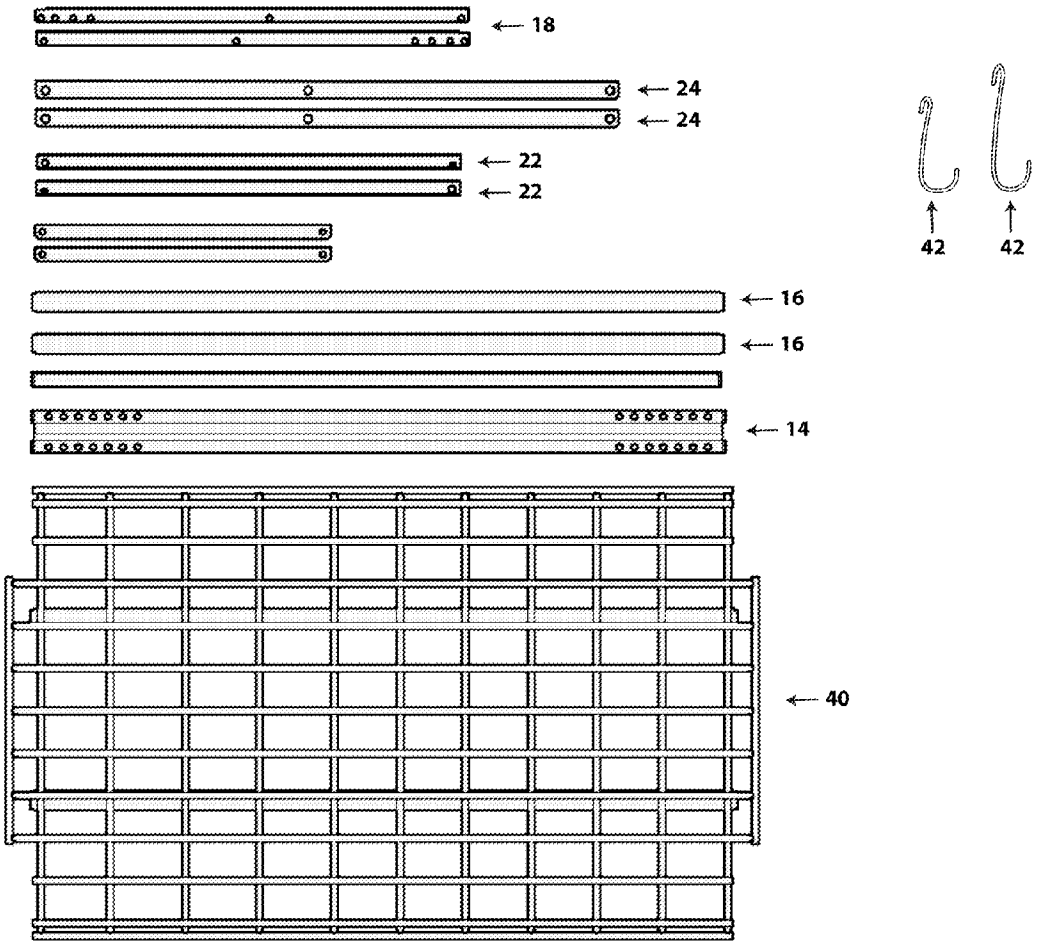
FIG. 10 is a parts view of the storage system shown in FIG. 1.

FIGS. 2 to 7 illustrate the steps required for an assembly of a plurality of storage systems. Individual parts are referred to by a capital letter and a listing of the parts is shown in FIG. 10.

Figure 2:
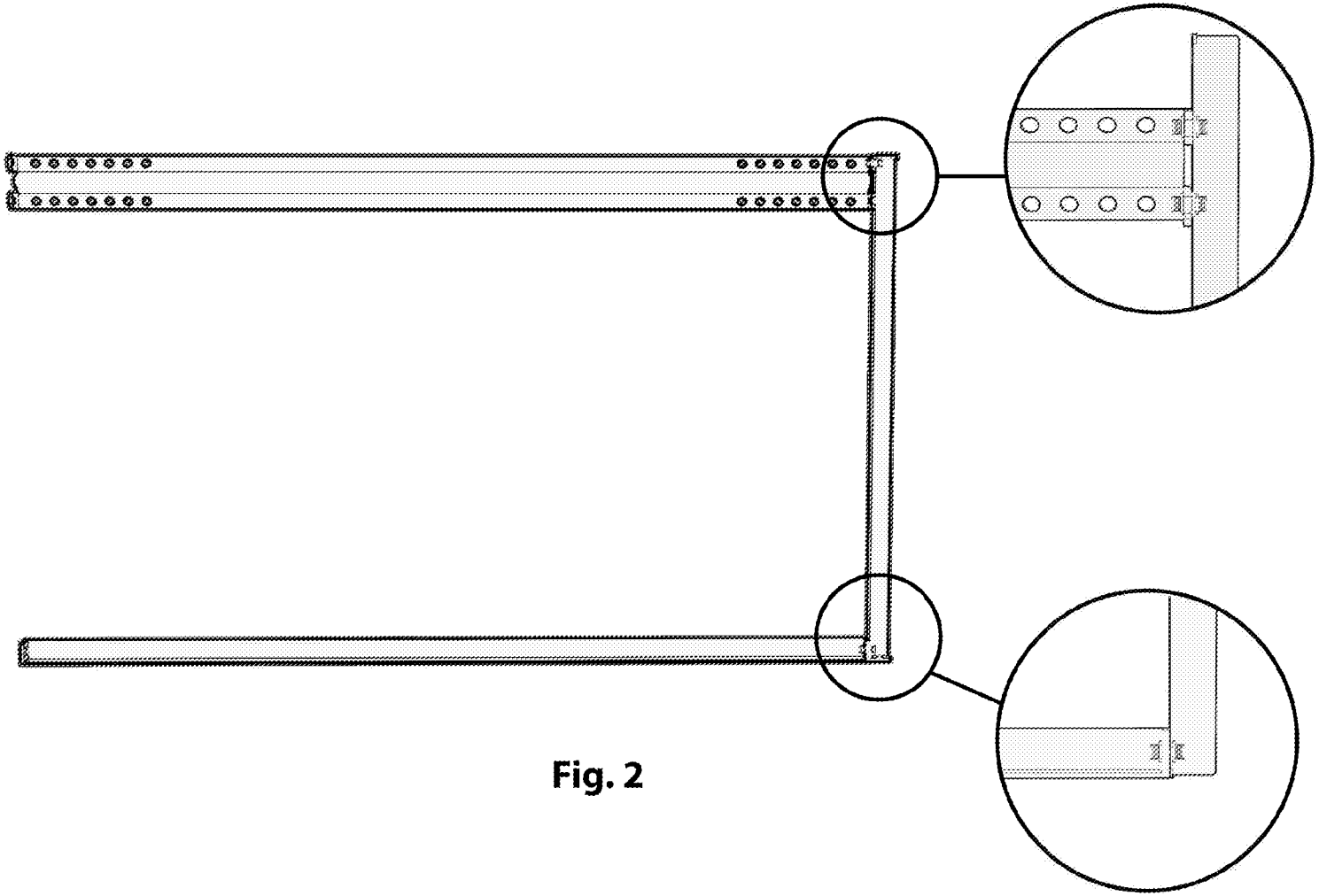
FIG. 2 is a perspective view illustrating an installation step of the storage system shown in FIG. 1.

Referring to FIG. 2, if one is installing more than one rack in a row, connect D to H and G. This can be either on the left or the right side depending on which way the extension will occur. Connect H and G to the existing N that is mounted on the wall, level, predrill and mount to wall.

Figure 3:
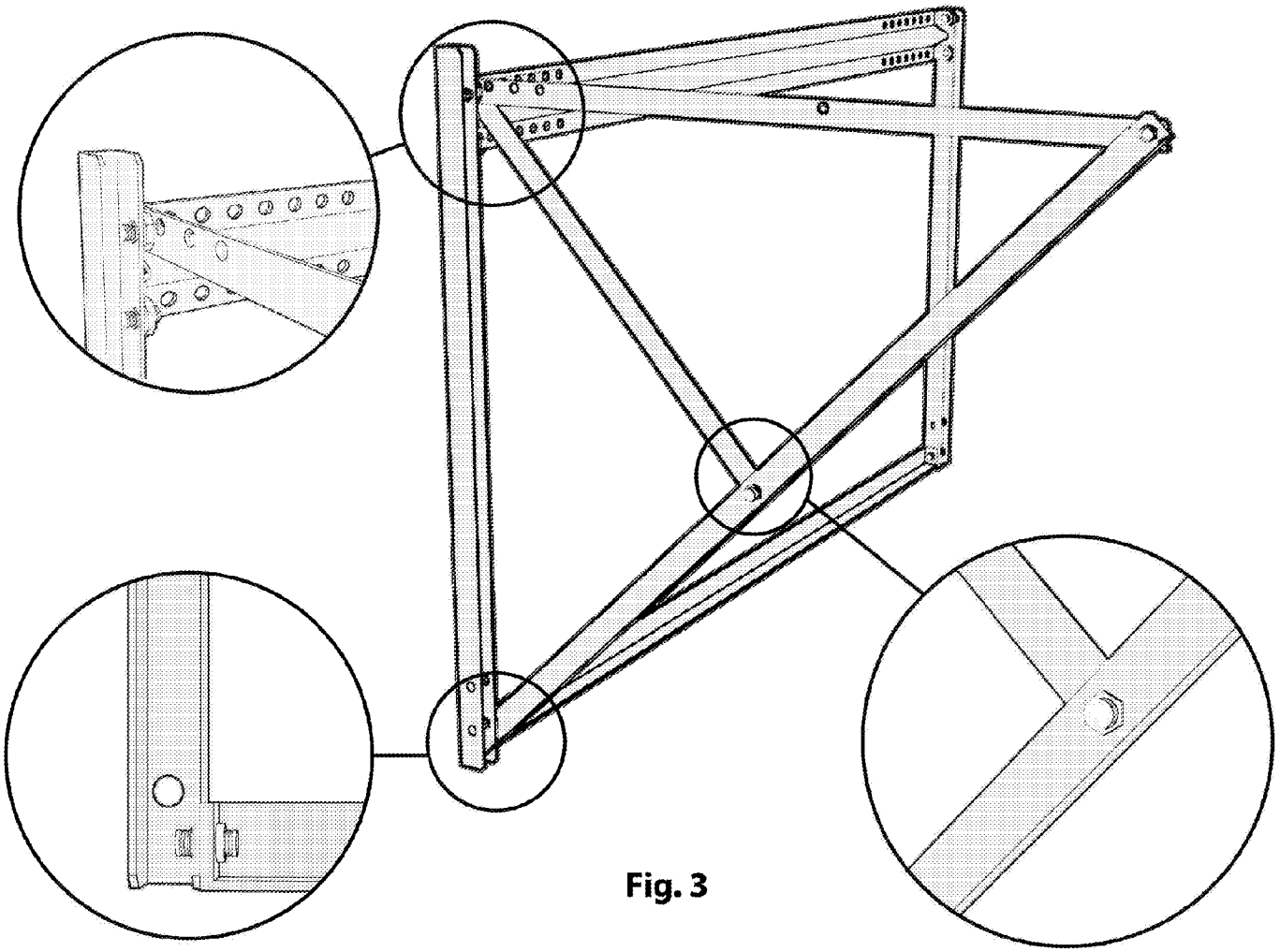
FIG. 3 is a perspective view illustrating another installation step of the storage system shown in FIG. 1.

Then the following steps can be carried out:

Referring to FIG. 3: Connect A to D and H.

Connect C and E together, then connect C and E to D.

Figure 4:
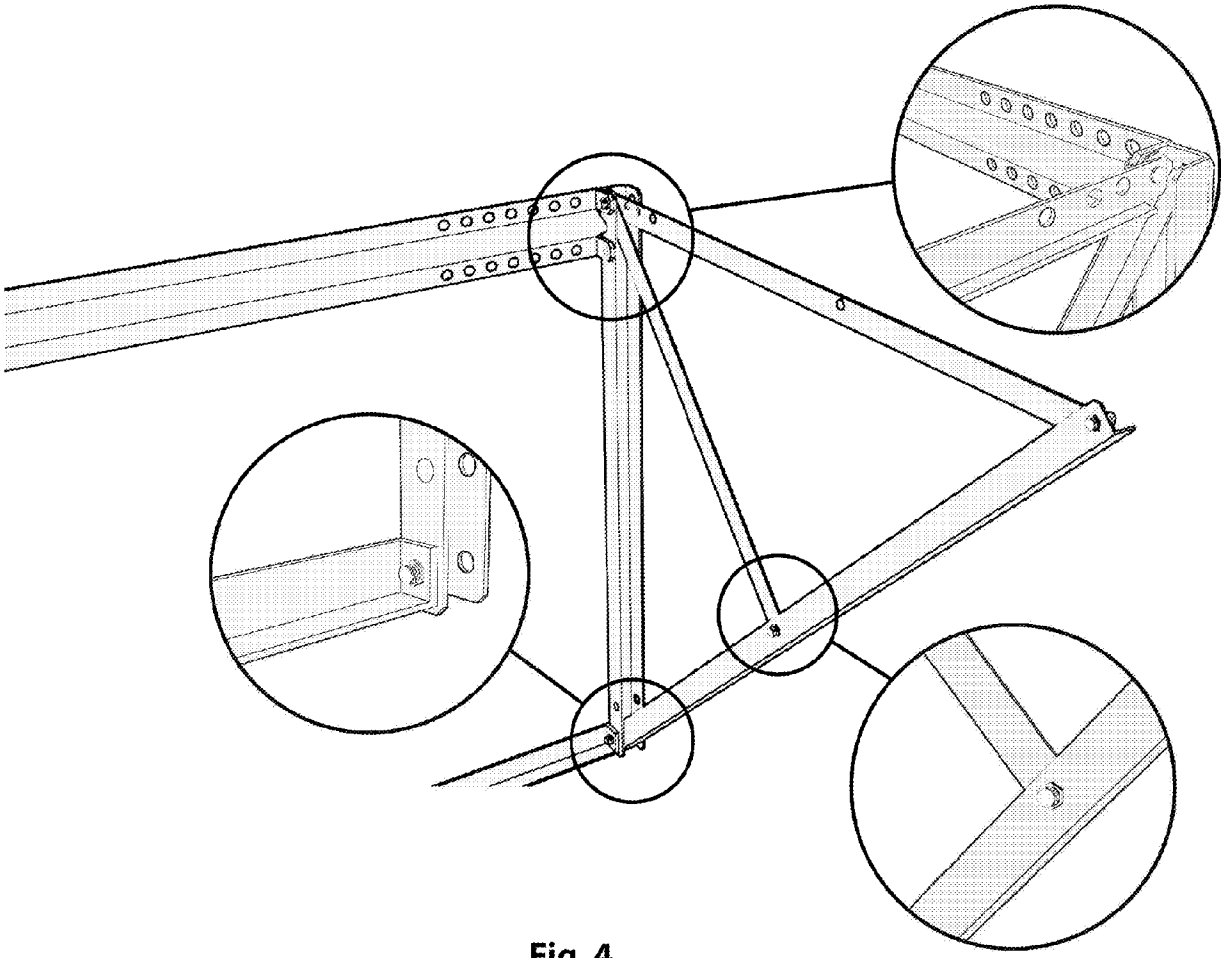
FIG. 4 is a perspective view illustrating an installation step of the storage system shown in FIG. 1.
Figure 5:
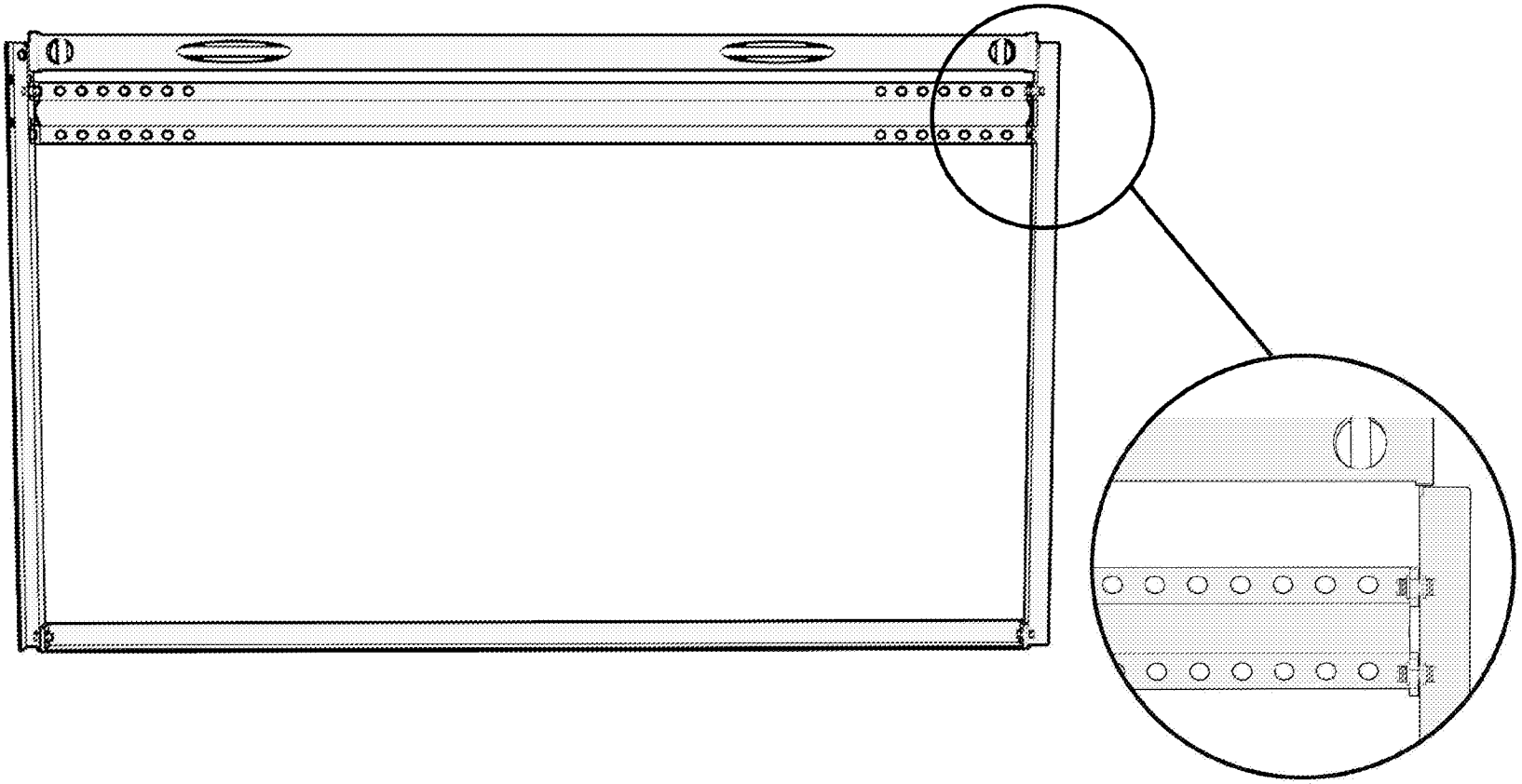
FIG. 5 is a perspective view illustrating an installation step of the storage system shown in FIG. 1.

Referring to FIG. 4 Connect B to D and H.

Connect C and E together, then connect C and E to D.

Once one has completed steps shown in FIGS. 3 and 4, installation of a second pair of crossmembers (F) can be done. An existing small bolt from the first rack is replaced with one longer bolt that will connect both storage systems together as better shown in FIG. 6.

Referring to FIG. 7, to install a second grill, first a lock pin is removed from the side from which the storage system is being extended. Then the second grill is installed. A small bolt is then placed through both A and B and tightened. A lock pin is then installed on other end.

FIGS. 8 and 9 illustrate different configurations and uses of the storage system. Other multiple storage systems and configurations extending laterally from either side can also be considered, as the system can be provided in multiple length configurations and further extensions can also be provided.

Figure 11A:
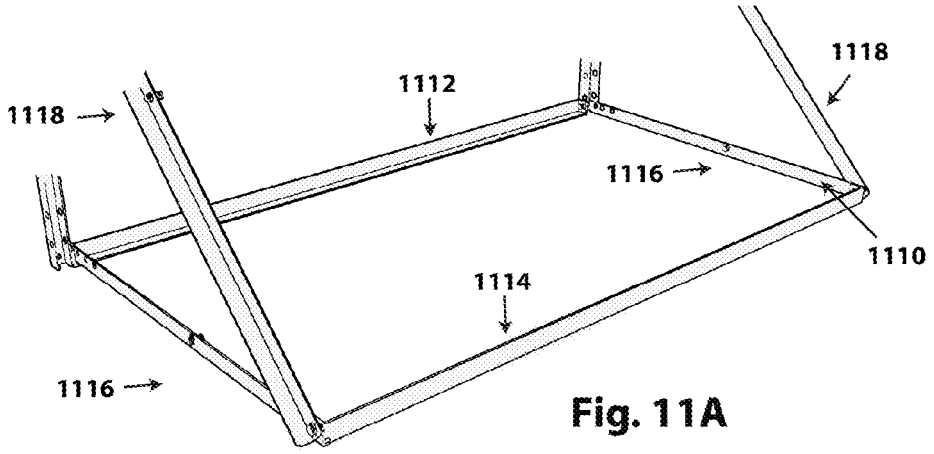
FIG. 11A is a perspective view of a tire rack accessory according to an embodiment of the present invention.
Figure 11B:
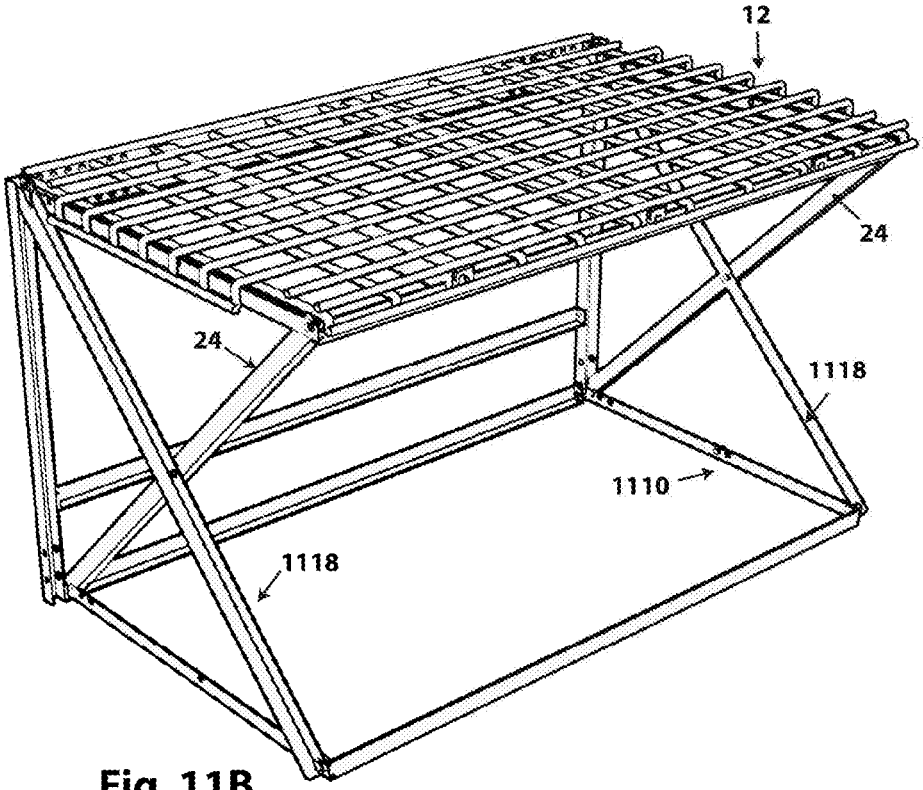
FIG. 11B is a perspective view of the tire rack accessory of FIG. 11A installed on a storage system.

FIGS. 11A and 11B show a tire rack accessory that can be installed on a storage system. As shown in FIGS. 11A and 11B, the tire rack accessory includes a secondary shelf support structure 1110 comprising a back portion 1112, a front portion 1114 and side portions 1116. Two secondary support brackets 1118 support the secondary shelf support structure 1110 in a generally horizontally disposed position, each of the two support brackets 1118 comprising a shelf-engaging portion connecting the secondary shelf support structure 1110 to the two support brackets 20 and bracing portions 24 supporting the primary shelf support structure 12.

Figure 12A:
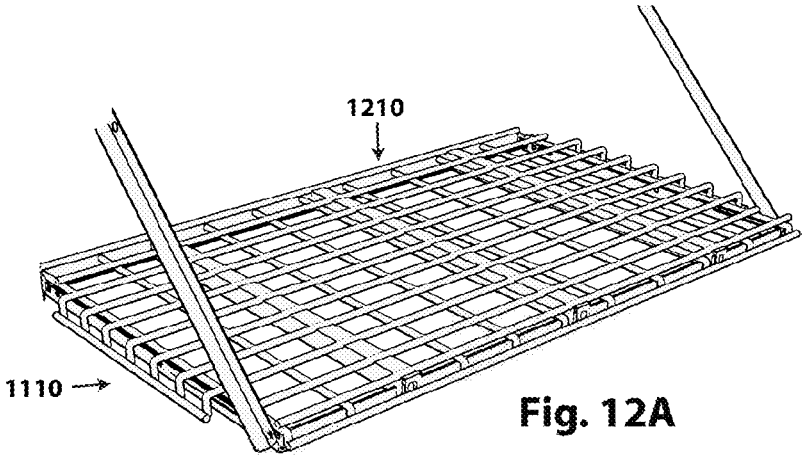
FIG. 12A is a perspective view of a secondary spaced wire shelf accessory according to an embodiment of the present invention.
Figure 12B:
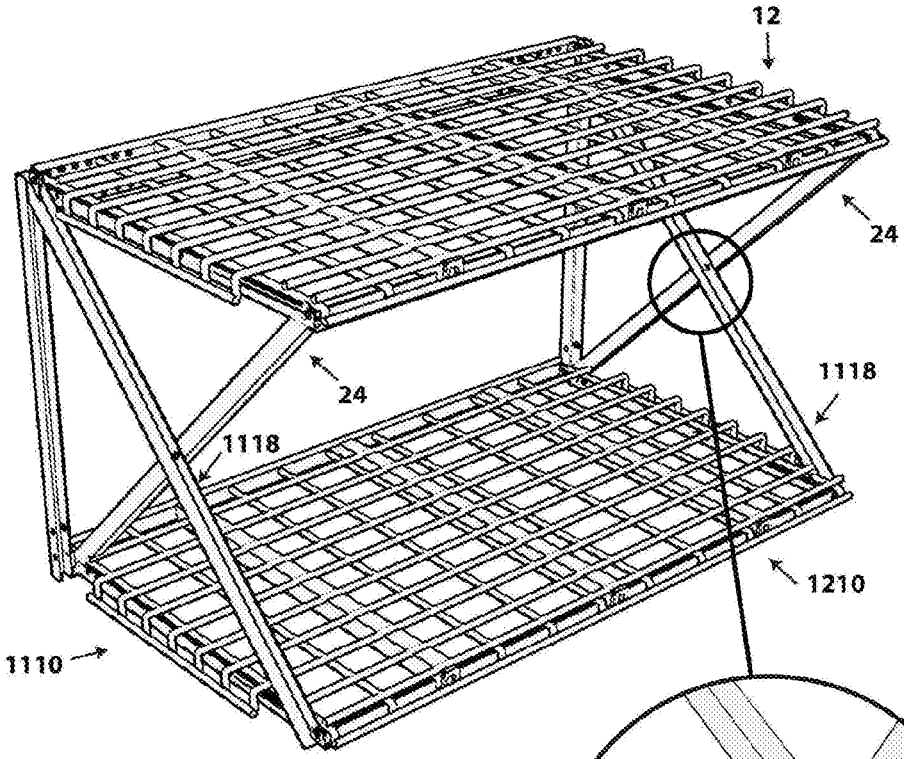
FIG. 12B is a perspective view of the secondary spaced wire shelf accessory of FIG. 11A installed on a storage system.
Figure 12D:
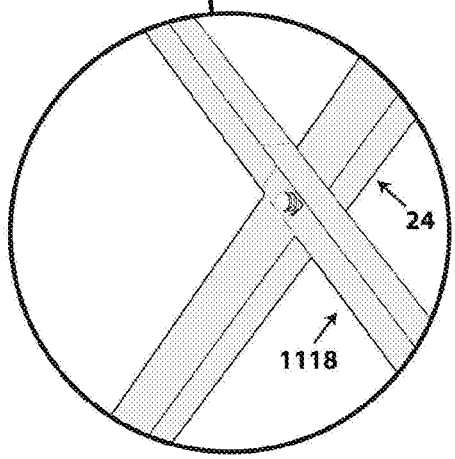
FIG. 12D is a detailed perspective view of linkage between the secondary spaced wire shelf accessory of FIG. 12B and the storage system.

FIGS. 12A to 12B show a secondary spaced wire shelf accessory that can be installed on a storage system. It is assembled in a manner similar to the tire rack accessory except that the secondary shelf support structure further comprises a spaced wire shelf supported by the secondary shelf support structure.

Figure 13A:
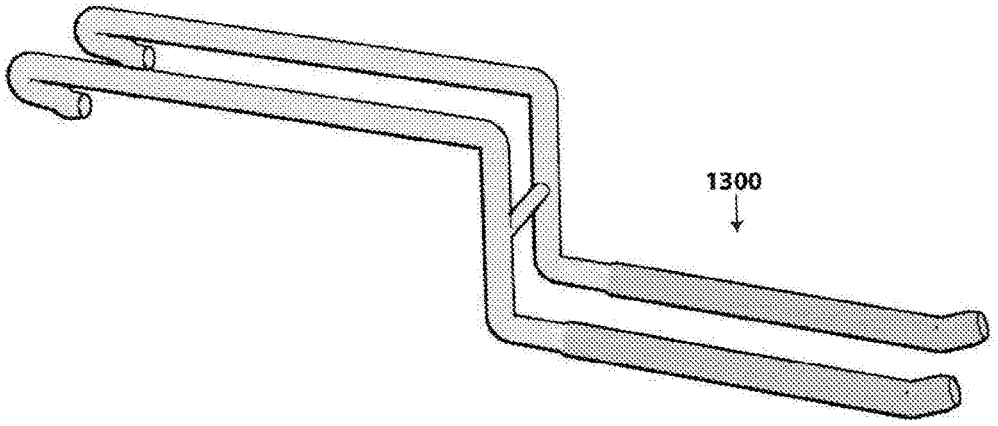
FIG. 13A is a perspective view of a side hook accessory according to an embodiment.
Figure 13B:
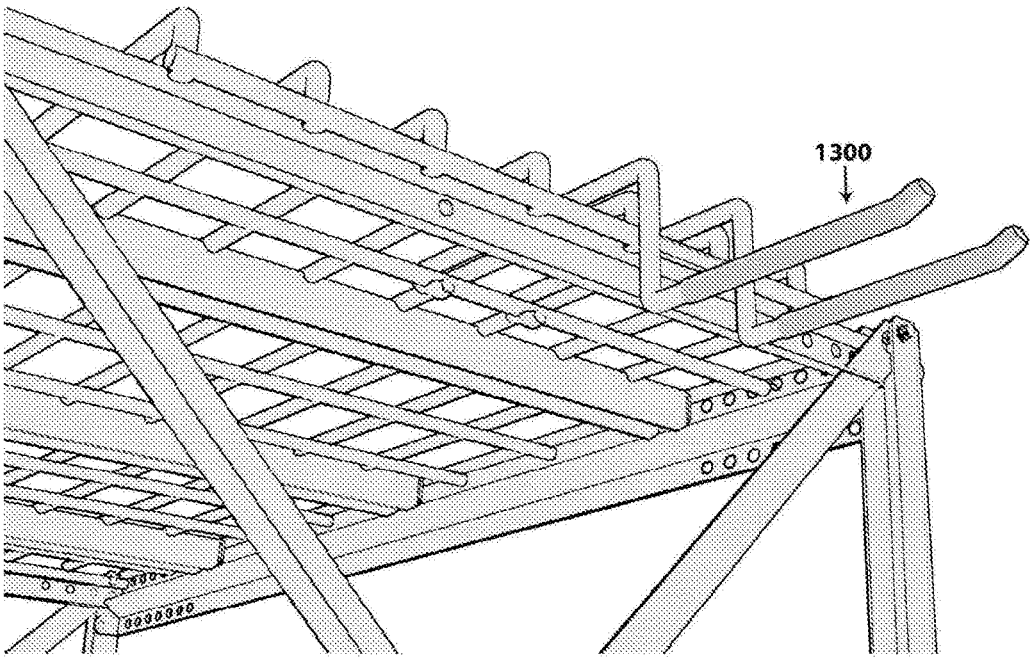
FIG. 13B is a perspective view of the side hook accessory shown in FIG. 13A installed on a storage system.

FIGS. 13A and 13B show a side hook accessory 1300 which can be installed on a storage system.

Figure 14A:
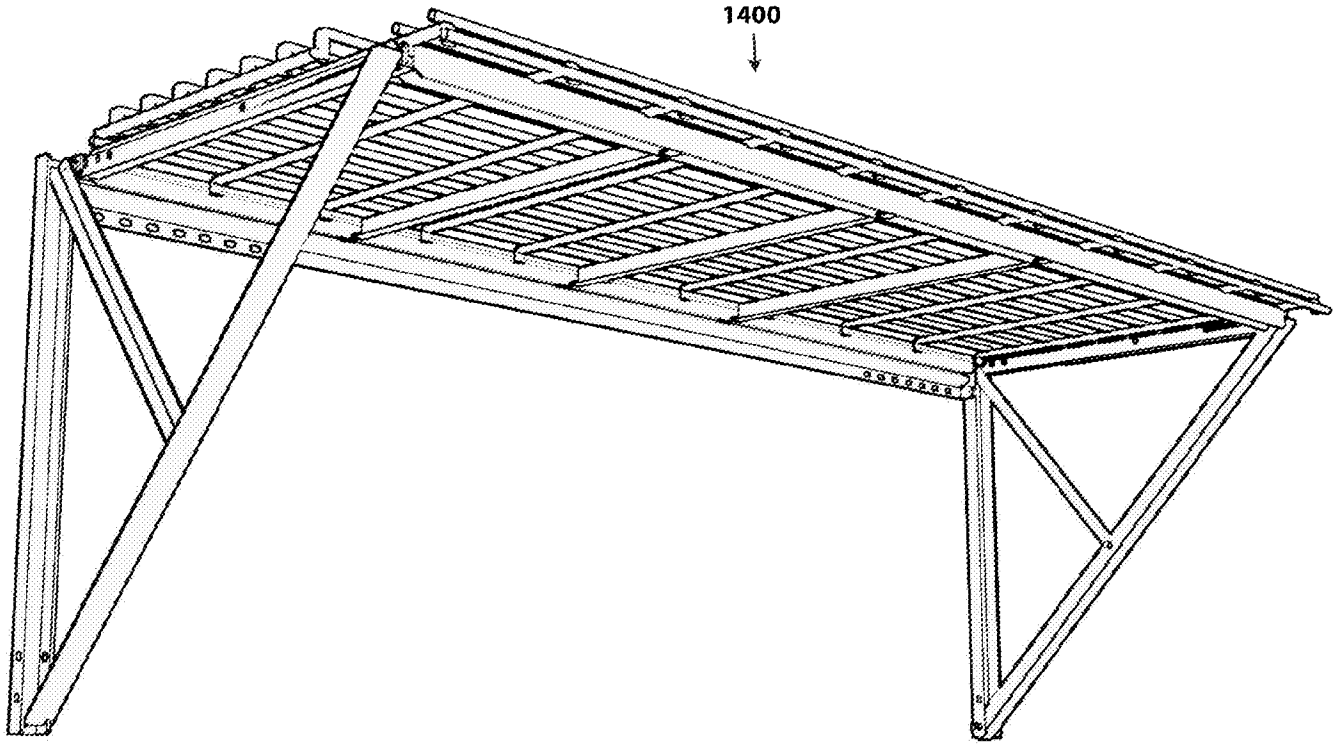
FIG. 14A is a perspective view of a reduced size version of the storage system according to another embodiment of the present invention.

FIG. 14A shows a reduced size version of the storage system 1400, according to another embodiment of the invention.

Figure 15:
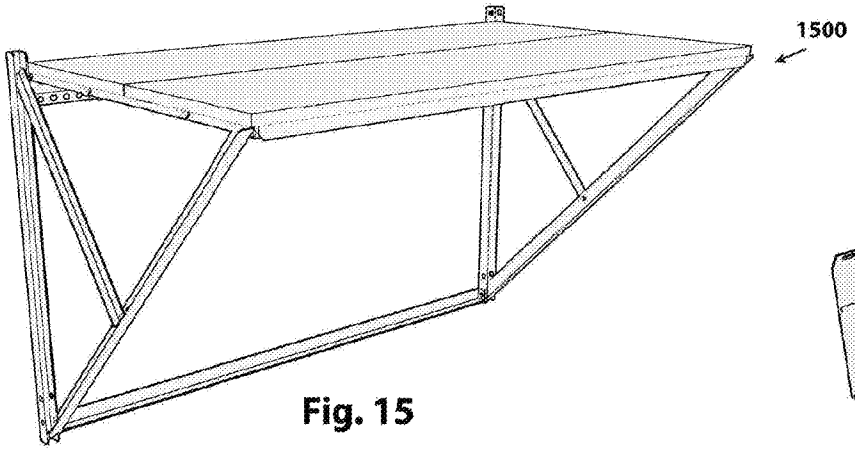
FIG. 15 is a perspective view of a storage system with a solid shelf in accordance with another embodiment of the present invention.

FIG. 15 shows a sample embodiment where the primary shelf support structure further comprises a solid shelf supported by the secondary shelf support structure.

Figure 16A:
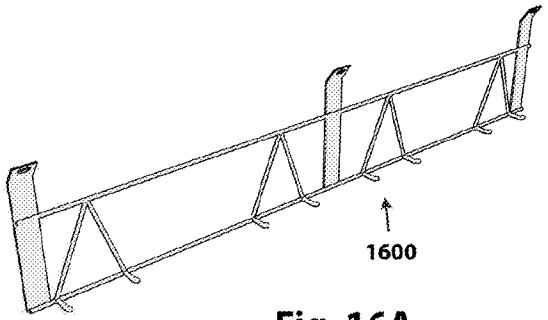
FIG. 16A is a perspective of a hook bracket assembly accessory according to an embodiment of the present invention.
Figure 16B:
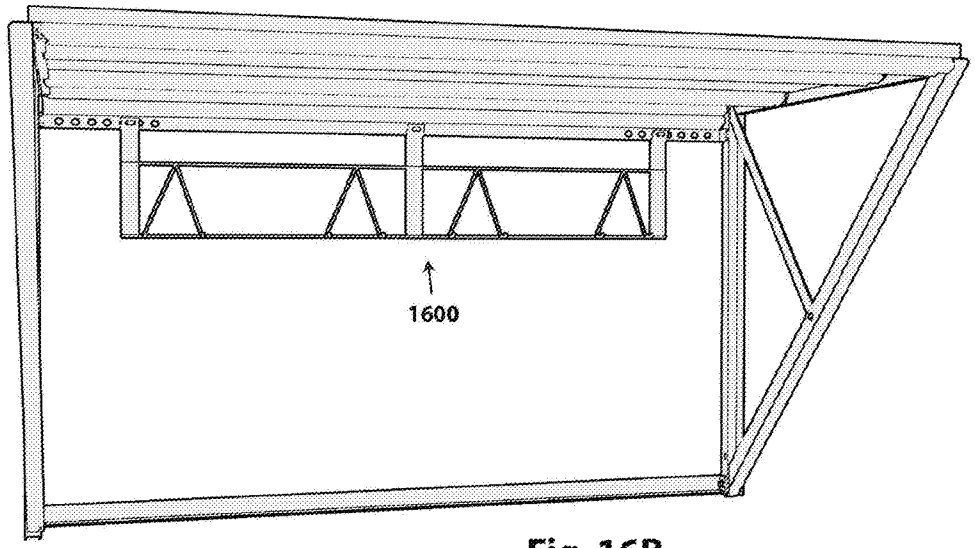
FIG. 16B is a perspective view of the hook bracket assembly accessory shown in FIG. 16A installed on a storage system.

FIGS. 16A and 16B show a hook bracket assembly accessory 1600 which can be installed on a storage system.

Figure 18:
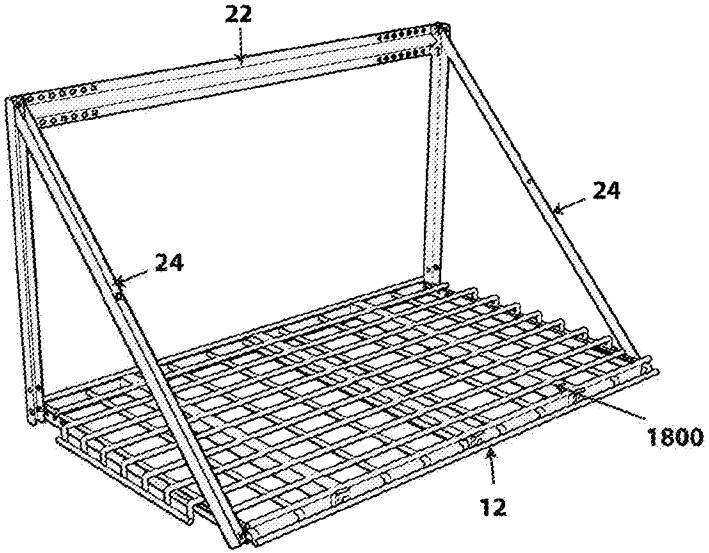
FIG. 18 is a perspective view of a storage system used as a storage rack according to another embodiment of the present invention.
Figure 17:
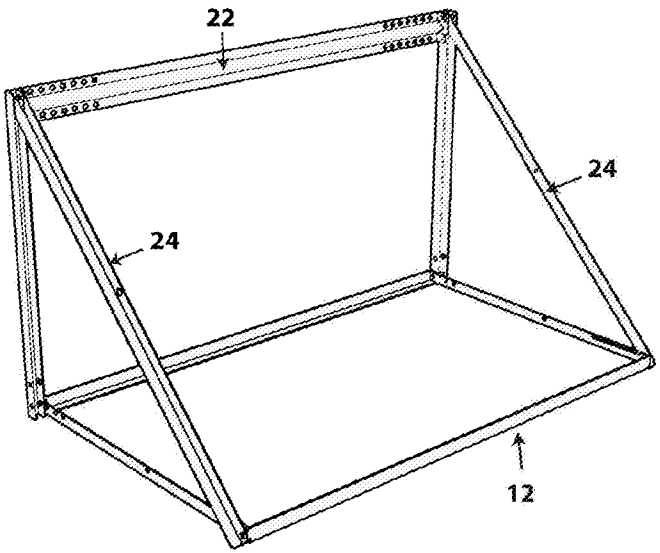
FIG. 17 is a perspective view of a storage system used as a tire rack according to another embodiment of the present invention.

FIGS. 17 and 18 show alternate embodiments of the storage system. In these embodiments, the bracing portions 24 extend downward from the wall engaging portions 22 to the primary shelf support structure 12. In FIG. 17, the primary shelf support structure 12 is sized to receive tires. In FIG. 18, the primary shelf support structure 12 further comprises a spaced wire shelf supported by the primary shelf support structure.

Of course, numerous modifications could be made to the above-described embodiments without departing from the scope of the invention, as defined in the appended claims.

The invention claimed is:

1. An expandable wall storage system mountable to a structural wall, the expandable wall storage system comprising:

a primary shelf support structure comprising a back portion, a front portion and side portions;

at least two support brackets for supporting said shelf support structure in a generally horizontally disposed position, each of said at least two support brackets comprising:

a wall engaging portion configured to connect with a portion of the structural wall and said back portion; and a bracing portion extending from said wall engaging portion to said primary shelf support structure;

an interface defined by said side portions and said at least two support brackets for engaging an adjacent expandable wall storage system when aligned in a side-by-side relationship; and an attachment assembly provided on a portion of said interface for attaching the expandable wall storage system to an adjacent expandable wall storage system when aligned in a side-by-side relationship, said attachment assembly comprising one or more holes for receiving a fastener for attaching two adjacent expandable wall storage systems.

2. The expandable wall storage system of claim 1, wherein said attachment assembly is provided along said side portions.

3. The expandable wall storage system of claim 2, wherein said attachment assembly is provided along said at least two support brackets.

4. The expandable wall storage system of claim 2, wherein said attachment assembly comprises an expansion joint integrated within said interface for engaging an adjacent expandable wall storage system.

5. The expandable wall storage system of claim 4, wherein said expansion joint is a U-shaped interlocking structure shaped for receiving front and back portions of two adjacent expandable wall storage systems.

6. The expandable wall storage system of claim 1, further comprising a shelf supported by said primary shelf support structure.

7. The expandable wall storage system of claim 6, wherein said shelf is a spaced wire shelf.

8. The expandable wall storage system of claim 7, further comprising one or more hooks hanging from said spaced wire shelf.

9. The expandable wall storage system of claim 6, wherein said shelf is a solid shelf.

10. The expandable wall storage system according to claim 1, further comprising:

a secondary shelf support structure comprising a back portion, a front portion and side portions; and at least two secondary support brackets for supporting said secondary shelf support structure in a generally horizontally disposed position, each of said at least two support brackets comprising a shelf-engaging portion connecting the secondary shelf support structure to the two support brackets supporting the shelf support structure.

11. The expandable wall storage system according to claim 10, wherein the secondary shelf support structure is sized to receive tires.

12. The expandable wall storage system according to claim 1, wherein the primary shelf support structure is sized to receive tires.

* * * * *